US005564577A

United States Patent [19]

Knaggs

[11] Patent Number: 5,564,577

[45] Date of Patent: Oct. 15, 1996

[54] ADJUSTABLE CLOTHES PROTECTOR APPARATUS

[76] Inventor: Pearl M. Knaggs, 715 Colwyn Ter., Deerfield, Ill. 60015

[21] Appl. No.: 294,208

[22] Filed: Aug. 22, 1994

[51] Int. Cl.[6] ..... A47F 5/00

[52] U.S. Cl. ..... 211/86; 211/105.6; 211/180; 160/24; 248/268; 248/291.1; 312/297

[58] Field of Search ..... 211/86, 105.1, 211/105.6, 183, 180; 160/56, 370.22, 24; 248/251, 268, 254, 257, 291; 312/297, 3–6

[56] References Cited

U.S. PATENT DOCUMENTS

| | | | |
|---|---|---|---|
| 225,101 | 3/1880 | Brackett | 312/3 |
| 890,875 | 6/1908 | Samuel . | |
| 920,197 | 5/1909 | Siegel | 312/3 |
| 942,580 | 12/1909 | McGregor et al. | 211/180 X |
| 1,037,417 | 9/1912 | Biggs | 312/3 |
| 1,571,366 | 2/1926 | Bender | 312/6 |
| 1,719,055 | 7/1929 | Herzer . | |
| 1,853,742 | 4/1932 | Owen et al. . | |
| 1,918,423 | 7/1933 | Persinger . | |
| 2,781,834 | 2/1957 | Woodard | 160/56 |
| 3,383,133 | 5/1968 | Dean | 296/98 |
| 3,913,655 | 10/1975 | Ogino | 160/84 R |
| 4,006,770 | 2/1977 | Ferguson | 160/263 |
| 4,073,455 | 2/1978 | Gunther | 248/291 |
| 4,118,066 | 10/1978 | Ricke | 297/184 |
| 4,828,319 | 5/1989 | Benson | 296/136 |
| 4,948,154 | 8/1990 | Guggenheim | 211/180 X |
| 4,971,210 | 11/1990 | Blumenkranz et al. | 211/105.1 X |

*Primary Examiner*—Alvin C. Chin-Shue
*Assistant Examiner*—Brian J. Hamilla
*Attorney, Agent, or Firm*—Olson & Hierl, Ltd.

[57] ABSTRACT

Apparatus is provided for protecting clothes hanging on a hanger bar in a closet from dust. The apparatus employs an elongated roller assembly that is provided with an extensible and retractable preferably transparent sheet member and also at least one elongated rod-like member. The roller assembly and the rod-like member(s) are in spaced, parallel relationship to the hanger bar. The relationship is such that the sheet member is extendible first transversely over the hanger bar to the rod-like member and then downwardly. Preferably the apparatus is width adjustable and can include a pair of adjustably transversely extending, and transversely elongated bracket structures that function to hold adjoining ends of the roller assembly and the rod-like member(s) and also to facilitate the apparatus installation in any one of various closets. The roller asembly may have a protective housing enclosing the sheet member. The housing has a slot to allow the sheet member to move therethrough and achieve its extended position. The sheet member may have a handle to assist in the retraction or extension of the sheet member.

33 Claims, 5 Drawing Sheets

ADJUSTABLE CLOTHES PROTECTOR APPARATUS

FIELD OF THE INVENTION

This invention lies in the field of clothes protector apparatus wherein an extensible and retractable sheet member is positionable over exposed top and side edge portions of clothing hanging from a clothes rod in a closet or the like.

BACKGROUND

When objects, such as clothing supported on hangers hung from a rod, are stored in a storage area, such as a clothes closet or the like, small sized, low density, air-suspended particulate matter (i.e., dust) settles thereon. Although dust can be transported in the environmental air of a building laterally and even upwardly, and can pass with air around corners and through small spaces such as exist between edge portions of a closed clothes closet door and adjacent portions of an associated door frame, the greatest source of dust that settles on clothing in a clothes closet is downward settling. Apparently, the air in a closet region is sufficiently quiescent to permit dust suspended therein to settle slowly downwardly (largely by gravity) into contact with hanging clothing. Dust that settles on clothing is unsightly, and commonly is removable by costly clothing cleaning.

Various closet dust protective measures for hanging clothing are known including, for example, (a) draping a cloth sheet over rod-hung clothes, (b) positioning individual clothing items in a rod-hung plastic garment bag, (c) placing specially formed protective covers or sheaths over shoulder portions of rod-hung clothes, and the like.

However, such measures suffer from various disadvantages. Thus, protective measure (a) is inconvenient, relatively unsightly, and of limited effectiveness (owing to the porous nature of cloth). Protective measure (b) is cumbersome, time consuming and costly (particularly when a plurality of garment bags must be used). Protective measure (c) is inherently limited in area of potential effectiveness, and also is inconvenient, cumbersome and costly.

An improved clothes protector apparatus and associated methods of installation and use are needed for protecting hanging clothing and the like. The present invention meets this need.

SUMMARY OF THE INVENTION

More particularly, this invention relates to clothes protector apparatus for hanger-suspended clothes hanging from a horizontal hanger bar means of the type that extends between a pair of opposed, spaced, parallel end walls.

The apparatus includes (a) an elongated roller assembly on which a sheet of protective material is wound and from which the sheet can be extended and retracted, and also (b) at least one elongated, rod-like, sheet guidance and support member.

In use, the roller assembly and the rod-like member(s) are each horizontally oriented and positioned in spaced, parallel relationship relative to one another and to a horizontal clothes hanger bar means. The sheet is retractably extendable and positionable from the roller, and, when extended, passes first in a transverse direction over hanging clothes and then in a downward perpendicular direction, all without contact with the hanging clothes. Thereby, the hanging clothes are protected from settling dust which collects on the extended sheet. Subsequent convenient access to the hanging clothes is achieved by retracting the sheet.

Preferably, the apparatus includes a pair of transversely extending, transversely elongated fastening bracket means. Each bracket means is located at a different opposite end region of the clothes protector apparatus and functions to position and to hold adjacent respective end portions of each of the roller assembly and the rod-like members. In a preferred form, each bracket means is articulatable at a mid-point, thereby to enhance positioning and holding capabilities and configurations and to permit easy and convenient installation of the clothes protector apparatus in the widest possible number of different closet configurations.

Preferably, the roller assembly and the rod-like member(s) are each adjustable in longitudinal length for purposes of achieving optimized fits in various different use environments. Also, the sheet is preferably adjustable in longitudinal width for similar reasons.

Preferably, the sheet is equipped along its outer end portion with an associated stiffener rod. Also, the sheet outer end portion is preferably equipped with handle means.

Preferably, the sheet is transparent.

Preferably, the roller assembly includes a cooperating exterior elongated container that has an elongated slot in one side thereof through which the sheet is extensible and retractable.

Preferably, the clothes protector apparatus is also provided with a pair of spacer means such that each spacer means is positionable at a different end region of the hanger bar means, thereby to enable clothes hung on the hanger bar means to be maintained both in horizontally spaced relationship to each respective one of the adjacent closet opposite end walls and also in a dust protective vertical relationship under the extended overlying sheet.

Other and further objects, aims, purposes, features, advantages, applications, embodiments variations and the like will be apparent to those skilled in the art from the present specification taken with the accompanying drawings and appended claims.

DETAILED DESCRIPTION

Figure 1:
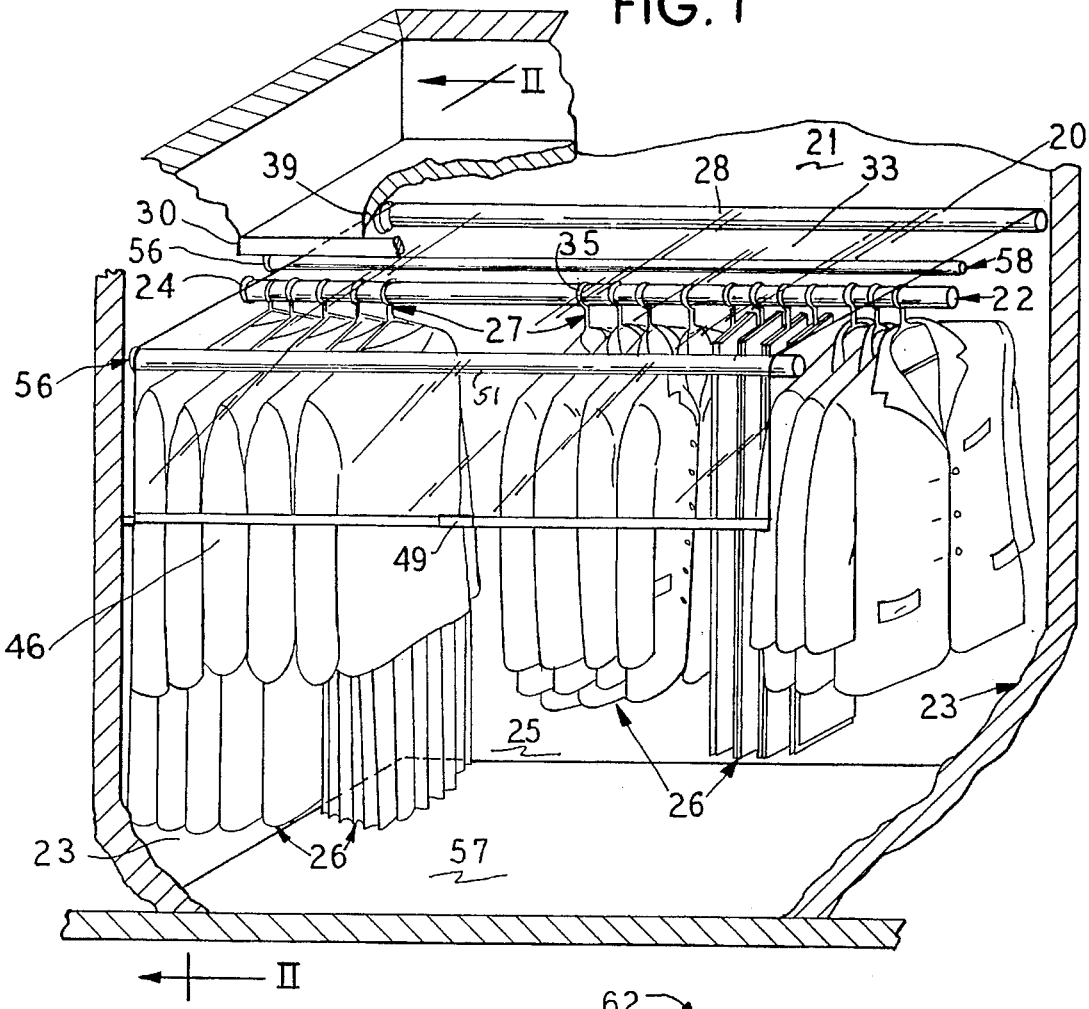
FIG. 1 is a diagrammatic perspective view of one embodiment of clothes protector apparatus of the present invention in functional association with an illustrative clothes closet, some parts thereof being broken away and some parts thereof being shown in section.
Figure 2:
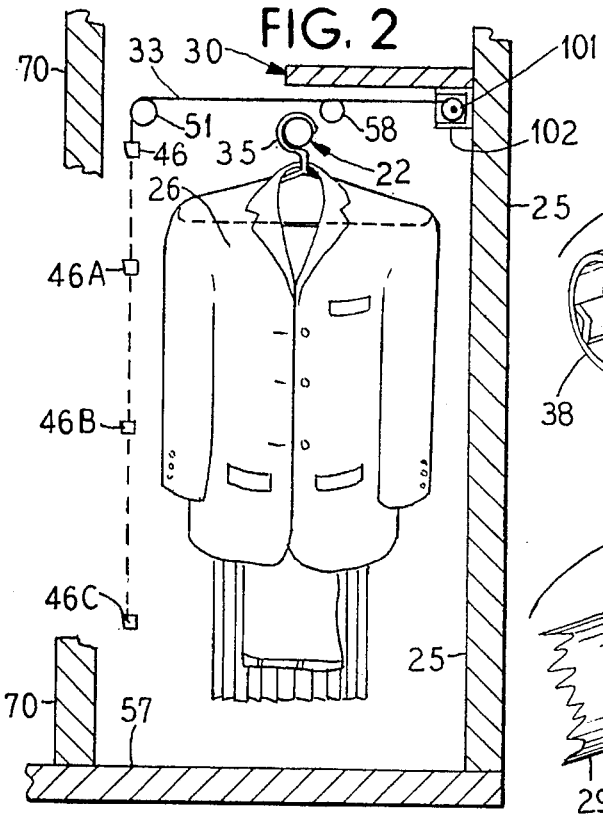
FIG. 2 is a diagrammatic vertical sectional view taken along the line II—II of FIG. 1, this FIGURE also illustrating the clothes protector apparatus with the embodiment of FIGS. 7A and 7B incorporated thereto.

Referring to the drawings, there is seen in FIGS. 1 and 2 an embodiment of clothes protector apparatus of this invention that is designated in its entirety by the numeral 20. Apparatus 20 is installed in an illustrative conventional clothes closet 21.

As is characteristic of a clothes closet generally, closet 21 is provided with a generally horizontal hanger bar 22 that extends between, and is supported at, its opposite ends by a pair of spaced, parallel closet 21 end walls 23. Here, bar 22 is illustratively supported at each of its respective opposite ends by a conventional wall-mounted bracket 24.

In closet 21, various illustrative individual items of clothing 26 are conventionally associated with conventional clothes hangers 27, and the upper hook 35 of each hanger 27 is engaged over bar 22 to achieve individual hanger support. The clothing 26 thus hangs perpendicularly and downwardly from bar 22 and extends crosswise relative to bar 22. Individual clothing items with shoulders each have a different respective shoulder portion located below and on a different opposed side of the hanger bar 22. Clothing 26 is in adjacent, spaced relationship to a closet 21 back wall 25 that extends longitudinally between the closet 21 end walls 23. Closet 21 is here additionally provided with an (optional) horizontal shelf 30 that is conventionally supported by the back wall 25 and/or the end walls 23 and that projects outwardly from back wall 25 to a terminal front edge located over bar 22.

Those skilled in the art will readily appreciate that closet 21 and its bar 22 arrangement are merely illustrative for present descriptive purposes only. The clothes protector apparatus 20, as can be appreciated from the present disclosure, is well adapted for association with virtually any conventional clothes closet or the like for purposes of achieving dust shielding and protection of hanger supported, rod-hung clothing 26 being stored in a closet (especially the top and exposed side portions of such clothing 26). At the same time, the apparatus 20 allows easy garment inspection and selection.

Figure 3A:
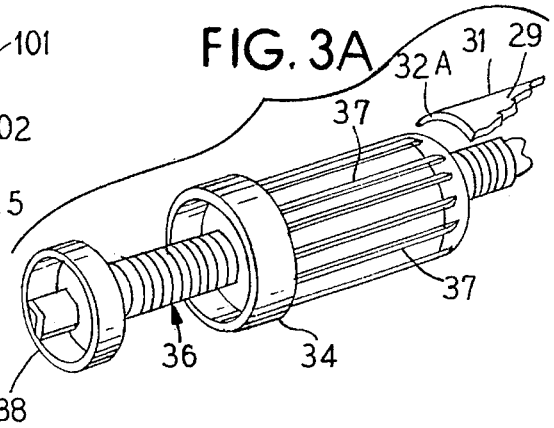
FIG. 3A and FIG. 3B show fragmentary exploded perspective views of the respective opposite end regions of the roller employed in the roller assembly of the clothes protector apparatus of FIG. 1.
Figure 3B:
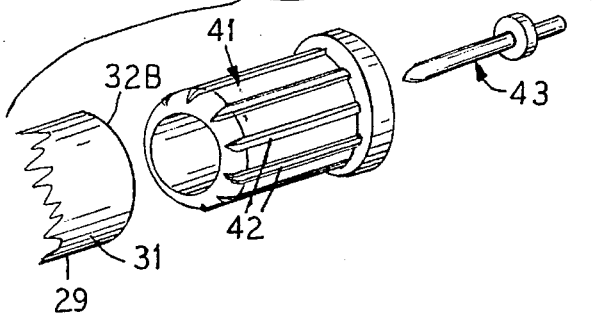

Clothes protector apparatus 20 includes an elongated roller assembly 28 that incorporates a generally and preferably hollow (i.e., tubular) roller 29 that has outer circumferentially extending surface portions 31 and opposite end portions 32A and 32B (see, for example, FIGS. 3A and 3B). A flexible, substantially dust impermeable, preferably dimensionally stable sheet 33 is initially conventionally secured to and then spirally wound about circumferential surface portions 31. Preferably sheet 33 is substantially transparent (for reasons of ease in clothing inspection) although opaque sheeting can be employed, if desired. Sheet 33 can be comprised of various materials, as those skilled in the art will appreciate, including for example polyolefins, such as oriented polypropylene or polyethylene; polyesters, such a polyethylene terephthalate; flexible vinyl resins; flexible polyamide resins; flexible acrylic resins; laminates of woven fabric and plastic; fiber reinforced, resin impregnated fabrics; and the like.

The roller 29 is provided with a conventional so-called motor mechanism by which, when roller 29 is revolved, the sheet 33 can be extended from its wound configuration about roller 29 to a desired extension position where the sheet 33 is stationary, and then subsequently retracted and re-wound about roller 29. The presently greatly preferred mechanism is an embodiment of the well-known spring-driven conventional window shade motor. Thus, as those familiar with the shade art appreciate, such a motor is received into the interior of the roller 29 and is effectively "wound" as sheet 33 is extended. Then, when sheet 33 is retracted, the motor provides the necessary motive power to rotate roller 29 and to retract (rewind) the extended sheet 33 to its fully wound position (although the retraction can be halted at some desired intermediate position, if the operator desires). The type of such a motor that is presently preferred for utilization in the practice of this invention is that shown and described in, for example, Ferguson U.S. Pat. No. 4,006,770.

When used as a component of roller assembly 28 (see FIG. 3A, for example,), a shade motor 36 is provided with a motor adaptor 34 that is conveniently comprised of molded plastic or the like. Adaptor 34 is inserted into the open one end 32A of roller 29. To achieve a snug and fixed association between adapter 34 and interior circumferential surfaces of end 32A, the adapter 34 is provided with a plurality of circumferentially spaced, preferably forwardly tapered, longitudinally extending, radially projecting ribs 37 that seat in, and engage interior surfaces of, the roller 29. The usual flat-sided end shaft 38 of motor 36 thus axially and outwardly extends from the end 32A of roller 29 and the adaptor 34. Shaft 38 is engaged in stationary association with a conventional wall mounted shade mounting bracket support 39 (such as illustratively shown in FIG. 4). During revolutions of roller 29, with the shaft 38 stationary, as sheet 33 is extended and retracted, motor 36 is thereby wound and unwound, respectively, as those familiar with the shade art will readily appreciate.

The opposite open end 32B of roller 29 is provided with another adapter 41 having a similar plurality of longitudinally extending, radially projecting ribs 42 that seat in adjacent interior surfaces of roller 29 in the tube end 32B. A cross-sectionally circular end pin 43 is mounted in the center opening of adaptor 41 and functions as an axially and outwardly projecting shaft that extends from the end 32B of roller 29 and the adaptor 41. Pin 43 is engaged in rotatable association with a conventional wall mounted shade mounting bracket support 44 (such as illustratively shown in FIG. 4). During rotations of roller 29, pin 43 rotates with roller 29 relative to bracket 44.

Motor 36 is conventionally provided with a ratchet and pawl arrangement (not shown) which permits sheet 33 to be stopped and positioned with its outer edge 46 in a selected position of extension and then to be later released and either further extended or retracted, as desired. Thus, the roller assembly 28 is adapted for extension, retraction and positioning of the sheet 33.

In order to adapt the roller assembly 28 for use in a variety of closets of varying longitudinal length, the roller 29 is adjusted in longitudinal length prior to installation in a particular closet. Such a length adjustment can be conventionally accomplished in various ways. In one technique (not detailed), the roller 29 is one piece construction such as rigid, laminated, rolled, impregnated paper sheets or the like and is simply cut to a desired length and the adapter 41 or the adapter 34 (as the case may be) is installed with its respective associated components in the cut end.

Figure 4:
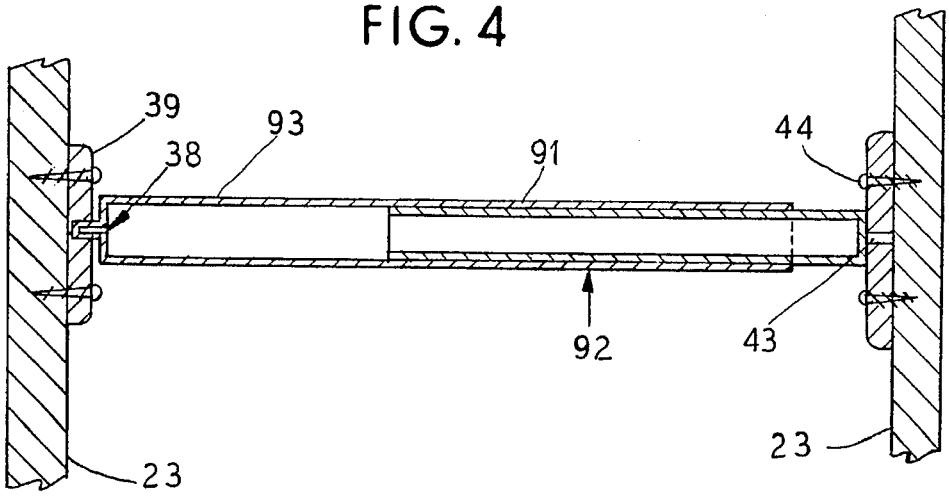
FIG. 4 is a fragmentary vertical longitudinal sectional view through another embodiment of a roller suitable for use in the roller assembly of FIG. 1.

In another technique (presently preferred), which is illustrated fragmentarily in FIG. 4, a longitudinally slidably adjustable roller structure 91 is employed in place of roller 29 wherein one section 92 of the roller 91 is telescopically receivable in another or second section 93 of the roller 91. The same combination of motor 36 and adaptor 34, and the same combination of pin 43 and adaptor 41, can be employed, if desired, in the opposite ends of the roller structure 91 (not detailed in FIG. 4). Also, roller structure 91 can be supported by the conventional brackets 39 and 44. Such a type of roller structure is disclosed, for example, in the afore cited Ferguson U.S. Pat. No. 4,006,770.

In order to adapt the sheet 33 for use in a variety of closets of varying longitudinal length, the sheet 33 is preferably adjustable in longitudinal width (relative to the longitudinal length of roller 29). Such a sheet width change can be conventionally accomplished in various ways. In one technique (not detailed), the sheet 33 is simply cut to a desired width while wound on roller 29 and while the roller 29 is concurrently being cut to a desired length.

Figure 5:
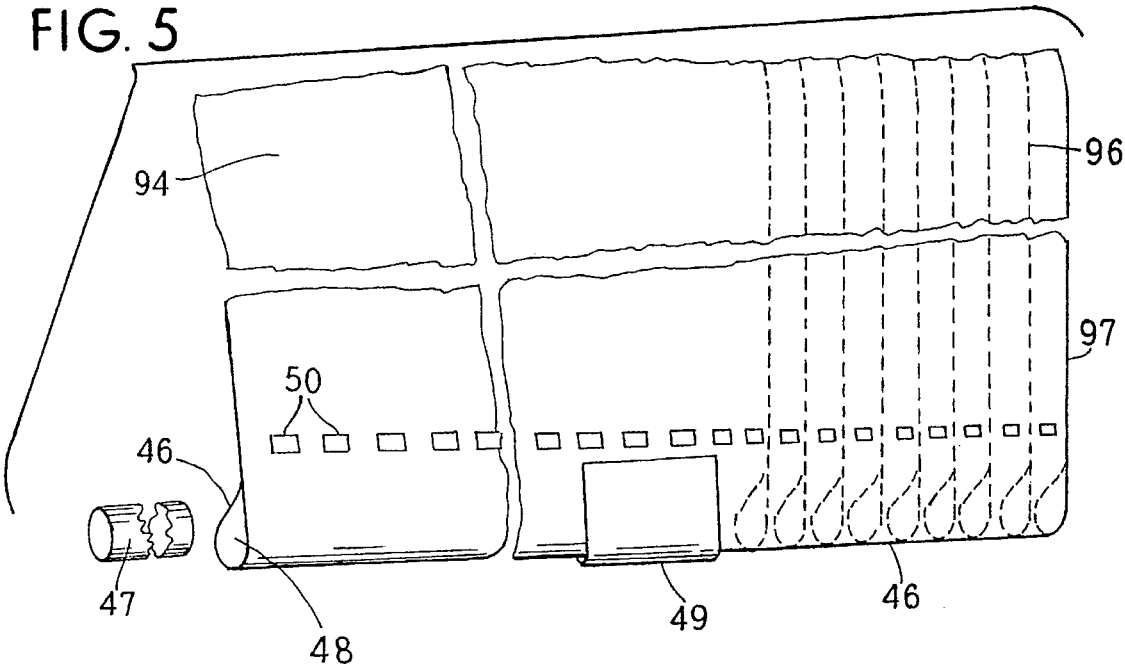
FIG. 5 is a fragmentary view in side elevation of the extended sheet that is associated with the roller assembly of FIG. 1.

In another technique (presently preferred), which is illustrated fragmentarily in FIG. 5, a sheet 94 is employed in place of sheet 33. Sheet 94 is provided with a plurality of spaced, parallel tear lines 96 that also extend parallel and adjacent to one edge 97 of sheet 94. The tear lines 96 each extend the full length of the sheet 94. The width of sheet 94 is thus adjusted by tearing off a desired edge portion of sheet 94 along a tear line 96. Such a sheet 94 is disclosed, for example, in the afore cited Ferguson U.S. Pat. No. 4,006,770 which is fully incorporated by reference into the present application.

The sheet 94 (or the sheet 33) is preferably associated along its outer, forward, longitudinally (relative to the associated roller 29 or roller 91, as the case may be) extending edge portion 46 with a stiffener rod or slat 47 (as illustrated for example in FIG. 5). Conveniently, for association with rod 47, the end of edge portion 46 is looped back upon itself and is adhesively intermittently bonded at locations 50, stitched, or the like to adjacent portions thereof, thereby to provide a longitudinal (relative to the associated roller) retaining channel 48 through which the stiffener rod 47 is receivable. Other means for associating rod 47 with sheet 94 means can be employed, if desired. Conveniently, a stiffener rod 47 is comprised of wood or plastic, and the length of a stiffener rod 47 is adjusted by cutting, sawing breaking on prescored transverse lines, or the like so as to match the width of the associated sheet 94.

The sheet 33 (or the sheet 94) is preferably associated with a grasping handle 49 (see FIG. 5) which handle is preferably comprised of molded plastic and which can have the conventional shade handle configuration that slidably mounts over the edge of a center region of the end portion 46 with its interiorly contained and thickened stiffener rod 47, as indicated in FIG. 5, for example.

The fact that a roller assembly can utilize components from the well developed shade art (except for the preference of a transparent sheet 33) is believed to be one of the desirable features of this invention because such utilization keeps fabrication costs down.

The clothes protector apparatus 20 further includes an elongated guidance and support rod-like member 51. In apparatus 20, the rod-like member 51 is conveniently mounted at each of its respective opposite ends to a different one of the end walls 23 by a conventional bracket 56 (not detailed). The brackets 56 can have various structures, but a present preference for reasons of availability and low cost is to employ for brackets 56 a structure that is similar to that associated with the hanger bar 22 brackets 24. Preferably, rod-like member 51 is cross-sectionally circular and tubular (i.e., hollow).

Rod-like member 51 can have various structures, as those skilled in the art will appreciate. As those skilled in the art will appreciate, a rod-like member 51 can be of any convenient or desired construction, a present preference being to employ a cylindrical, tubular structure. In one presently preferred structure, for example, the rod-like member 51 is formed as a single tube comprised of a metal, such as steel or the like, as shown in FIGS. 1 and 2, for example. To adjust the length of such a rod-like member 51, an installer simply cuts away an end portion of rod 51 to fit across the closet 21.

Figure 6:
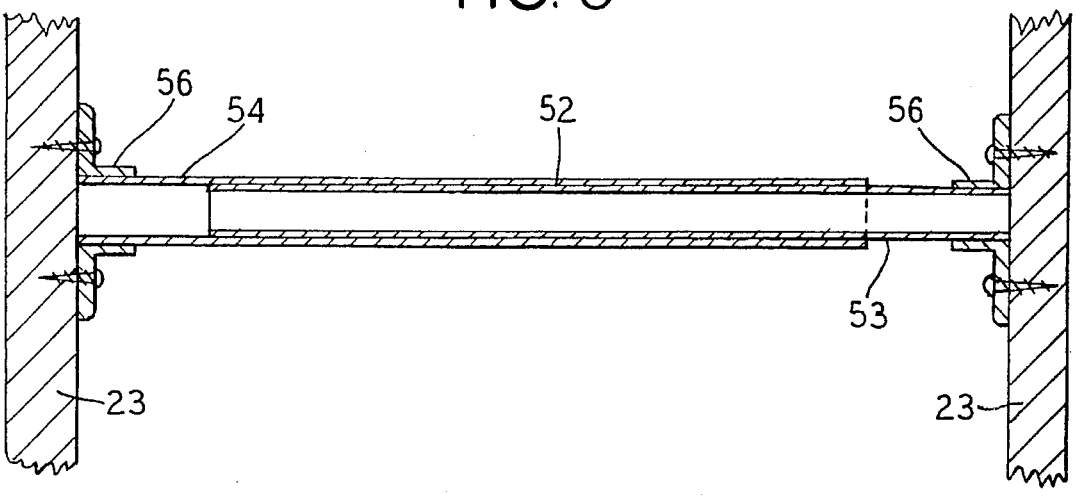
FIG. 6 is a fragmentary view in side elevation showing an embodiment of an alternative rod-like member adapted for use in this invention.

Another rod-like structure 52, which can be used in place of rod-like structure 51, is shown in FIG. 6. The rod-like structure 52 is comprised of metal or plastic, and, in this structure, a first tubular member 53 is telescopically received within a second tubular member 54. Thus, the length of rod-like structure 52 can be adjusted by varying the extent to which the component first tubular member 53 is slidably received within the component second tubular member 54. Rod-like structure 52 is mounted at its opposite ends by the conventional brackets 56 that are themselves mounted to respective ones of the end walls 23 by screws or like fastening means.

In the closet 21, the roller assembly 28 and the rod-like structure 51 are each preferably horizontally oriented and positioned in spaced, parallel relationship relative to one another and also to the hanger bar 22. The roller assembly 28 can be variously located in the vicinity of the hanger bar 22. Preferably, for reasons of dust protection of the clothing 26, the roller assembly 28 is positioned at a location at a height that is about equal to or greater than hanger bar 22 and that is approximately between the hanger bar 22 and the back wall 25 (including a possible location if desired that is adjacent to the back wall 25, as shown illustratively in FIGS. 1 and 2). The roller assembly 28 is preferably positioned somewhat higher than the hanger bar 22 if available space permits.

The rod-like structure 51 is preferably positioned in transversely spaced (in closet 21) parallel relationship to roller assembly 28. Also, the rod-like structure 51 is located on the opposite side of closet 21 from that associated with the back wall 25. Additionally, the rod-like structure 51 is preferably located so as to be above and preferably also perpendicularly slightly beyond the shoulder (and arm) regions of the hung clothing 26. Further, the rod-like member is preferably located so as to be nearly horizontally positioned in relation to the roller assembly 28 yet is within the closet 21 in spaced relationship to any forward closet wall or closet door jamb 70 (see FIG. 2), to take advantage of available closet space.

Thus, as the clothes protector apparatus 20 is preferably associated with the closet 21, the sheet 33 is preferably (and as shown) extended from the roller assembly 28 first in a transverse orientation (preferably about a horizontal direction). Then, after passing over the rod-like structure 51, sheet 33 extends in a vertical (downward) direction so as to be in a vertical plane that preferably is in adjacent, transversely spaced relationship to the hung clothing 26. The location of the outer end portion 46 of sheet 33 between (or the distance of end portion 46 from) the rod-like structure 51 (or the distance between end portion 46 and the underlying floor surface 57) can vary and is a matter of user preference. Various illustrative possible positions for end portion 46 are shown in phantom in FIG. 2 as 46A, 46B and 46C, respectively.

Optionally, but preferably, the clothes protector apparatus 20 may be equipped with more than the single rod-like structure 51. For example, and as shown in FIGS. 1 and 2, the clothes protector apparatus 20 is provided with a second rod-like structure 58 (and is with associated similar supporting brackets 56). The rod-like structure 58 in apparatus 20 is preferably similar in structure to rod-like structure 51, or to the rod-like structure 52, if desired, depending upon whichever rod-like structure is being used in a given embodiment of the clothes protector apparatus of this invention. The rod-like structure 58 is preferably in spaced, parallel relationship to the rod-like member 51, the roller assembly 28 and the hanger bar 22. When used, the rod-like structure 58 in apparatus 20 as preferably installed in a closet 21 so as to be in the vicinity of but over the hanger bar 22 and about mid-way transversely between the roller assembly 28 and the rod-like structure 51. Various arrangements can be used. When used, and installed in a closet 21, the rod-like structure 58 tends to prevent any sag in the sheet 33 between roller assembly 28 and rod-like structure 51.

Many different closet layouts exist, but the apparatus 20 is universally adapted for installation in most closets. The second rod-like structure 58 is particularly useful where, in a particular closet installation, the circumstances are such that the sheet 33 cannot extend directly from the roller assembly 28 to rod-like structure 51, as when, for example, the roller assembly 28 must be located at a height which is about equal to, or is actually somewhat below, the hanger bar 22 (but preferably above the shoulder level of hanging clothes 26). In this installation situation, the sheet 33, as it is extended, first preferably passes at an upward angle so as to extend over and be supported by the second rod-like structure 58 which itself is conveniently located over and above the hanger bar 22. Then, the outer end 46 of sheet 33 passes over the rod-like structure 51 which is situated as above described.

For general purposes, as when the apparatus 20 is being manufactured and sold in a disassembled "kit" form, it is preferred to employ two rod-like members, such as members 51 and 58, although three or more rod-like members can be employed, if desired, as those skilled in the art will appreciate, in a single apparatus 20 embodiment.

As those skilled in the art will appreciate, the stiffener rod 47 is useful in functional coaction with a rod-like support structure 51 and also even when a rod-like support structure 52 or the like is/are employed, to aid in guiding the sheet 33 and also to enhance weight distribution along these rod-like members, particularly during sheet 33 extension and retraction movements.

Figure 7B:
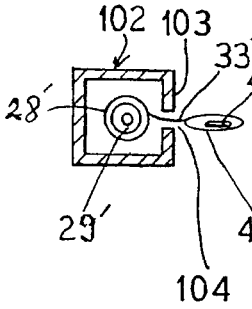
FIG. 7B is a vertical sectional view taken along the line VIIB—VIIB of FIG. 7A.
Figure 7A:
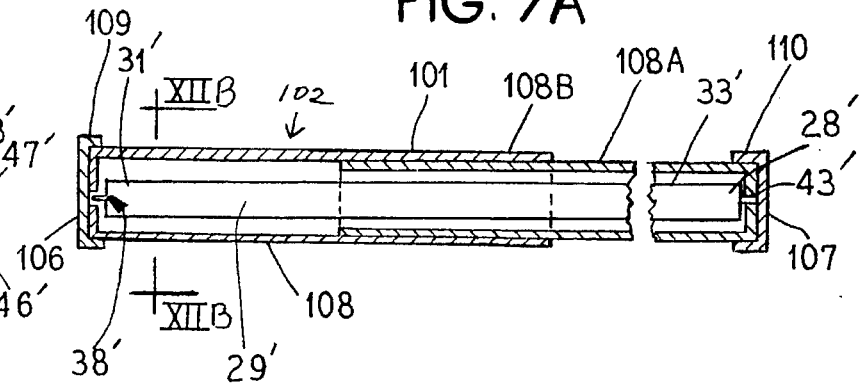
FIG. 7A is a fragmentary enlarged longitudinal sectional view of an alternative roller assembly wherein the coiled sheet member and roller are contained within an elongated housing.

An alternative roller assembly 101 which can be employed in place of roller assembly 28 is shown fragmentarily in FIGS. 7A and 7B. Roller assembly 101 is similar to roller assembly 28, but roller assembly 101 is provided with an elongated, cross-sectionally square housing 102 formed of, for example, molded (e.g., extruded) plastic, laminated plastic impregnated cellulosic sheets, frame reinforced sheet metal or the like. Components in roller assembly 101 which are similar to components in roller assembly 28 are similarly numbered, but with the addition of prime marks thereto for identification purposes. One elongated rectangular side wall 103 of housing 102 has defined therein an elongated slot 104 through which sheet 33' is slidably extendable and retractable from roller 29'. Similar to sheet 33, sheet 33' has an end portion 46' that encircles a stiffener rod 47'.

Housing 102 has a structure that includes a main or central portion 108 which is comprised preferably of four unitarily associated side walls and a pair of square configured end caps 106 and 107. Central portion 108 is provided with a pair telescopically engaging sections 108A and 108B for length adjustment of housing 102. Each end cap 106 and 107 is provided with continuous perimeter terminal side flanges 109 and 110 that are each nestably receivable into a different respective opposite end of central portion 108, thereby to complete the enclosure provided by housing 102. End cap 106 is provided with an internal integral bracket structure that is adapted to engage flat shaft 38' when the end cap 106 is engaged with one end of central portion 108, while end cap 107 is provided with an internal integral bracket structure that is adapted to engage pin 43' when the end cap 107 is engaged with the opposite end of central portion 108. Each side flange 109 and 110 is provided with a small projection (not detailed) that is received in a mating recess (not shown) defined at each corner of the central portion 108 so that each end cap 106 and 107, as received into a respective end of central portion 108, enters on to a retaining but releasable snap-fit engagement. To adjust length of housing 102, either end of central portion 108 can be transversely cut with a saw or the like to adjust the length of housing 102 to accommodate adjustments in length of roller 29' and sheet 33' before association with end caps 106 and 107.

Figure 8:
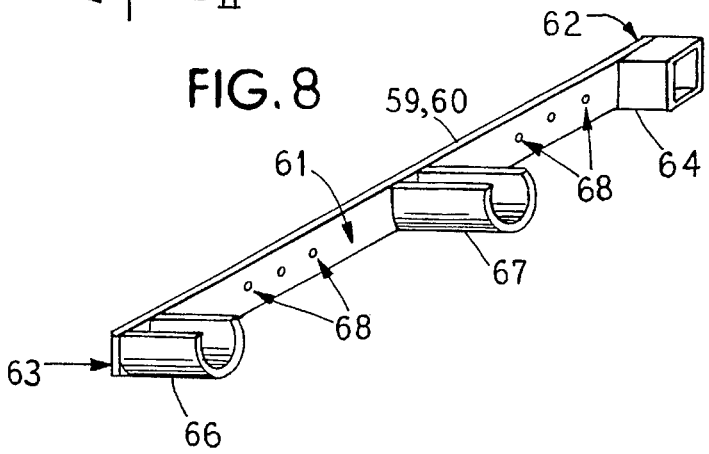
FIG. 8 is a perspective view of one embodiment of one member of a pair of brackets that are adapted for use in the clothes protector apparatus of FIG. 1, this view showing as representative the left hand member of such bracket pair.

From the standpoint of an amateur installer, such as a home owner, apartment dweller or the like, the problems arising during installation of an embodiment of clothes protector apparatus of this invention could sometimes prove to be somewhat time consuming and even seemingly tedious. To avoid such installation problems and to achieve a simplified and brief installation procedure, it is now preferred to incorporate into the apparatus combination 20 of this invention a pair of transversely extending, transversely elongated fastening bracket structures. One illustrative embodiment of one member 59 of such a pair of bracket structures 59 and 60 is shown for convenience in phantom in FIG. 8. An embodiment of the representative left-hand bracket structure 59 of such a pair of brackets (the right-hand member being a mirror image of the left-hand member) is, as indicated, shown in FIG. 8. The left bracket structure 59 is located on the left side of apparatus 20, and the right bracket structure 60 is located on the right side of apparatus 20. Bracket structure 59 is illustrative of each bracket.

Bracket 59 has an elongated metal support plate 61 with a rear end 62 and a forward end 63. Rear end 62 is associated by welding or the like with a longitudinally inwardly projecting, square configured U-shaped support collar 64 that is illustratively adapted to receive therein one end of the housing 102 of alternative roller assembly 101. Alternatively, if desired, the collar 64 can be configured (not shown) to receive one end 32A of roller assembly 28. Forward end 63 is similarly associated with a longitudinally inwardly projecting U-shaped support collar 66 adapted for receiving one end of rod-like structure 51. Medially positioned between forward end 63 and rear end 62 and similarly associated with plate 61 is another longitudinally inwardly projecting U-shaped support collar 67 for one end of rod-like structure 58. Holes 68 are provided in plate 61 for extending therethrough conventional fasteners, such as screws, nails or the like to mount bracket 59 to end wall 23. In place of metal, brackets 59 and 60 can be formed of a molded plastic, such as a polyolefin, a polyamide or the like if desired.

Bracket 59 is easily installed on end wall 23 in either a generally horizontal or an inclined orientation (depending upon conditions existing in the closet where an installation is to be made) by first either positioning collar 67 above hanger bar 22 or positioning collar 64 at some desired location where collar 66 is above and slightly outwardly spaced from the shoulders of clothes 26. Then, while so positioned, the fasteners (not shown) are extended through holes 68 to complete the mounting. The right hand bracket 60 is correspondingly installed in the opposite end wall 23. Thereafter, the roller assembly 101 and the rod-like structures 51 and 58 are associated with the respective brackets to complete the apparatus 20 installation.

Figure 9:
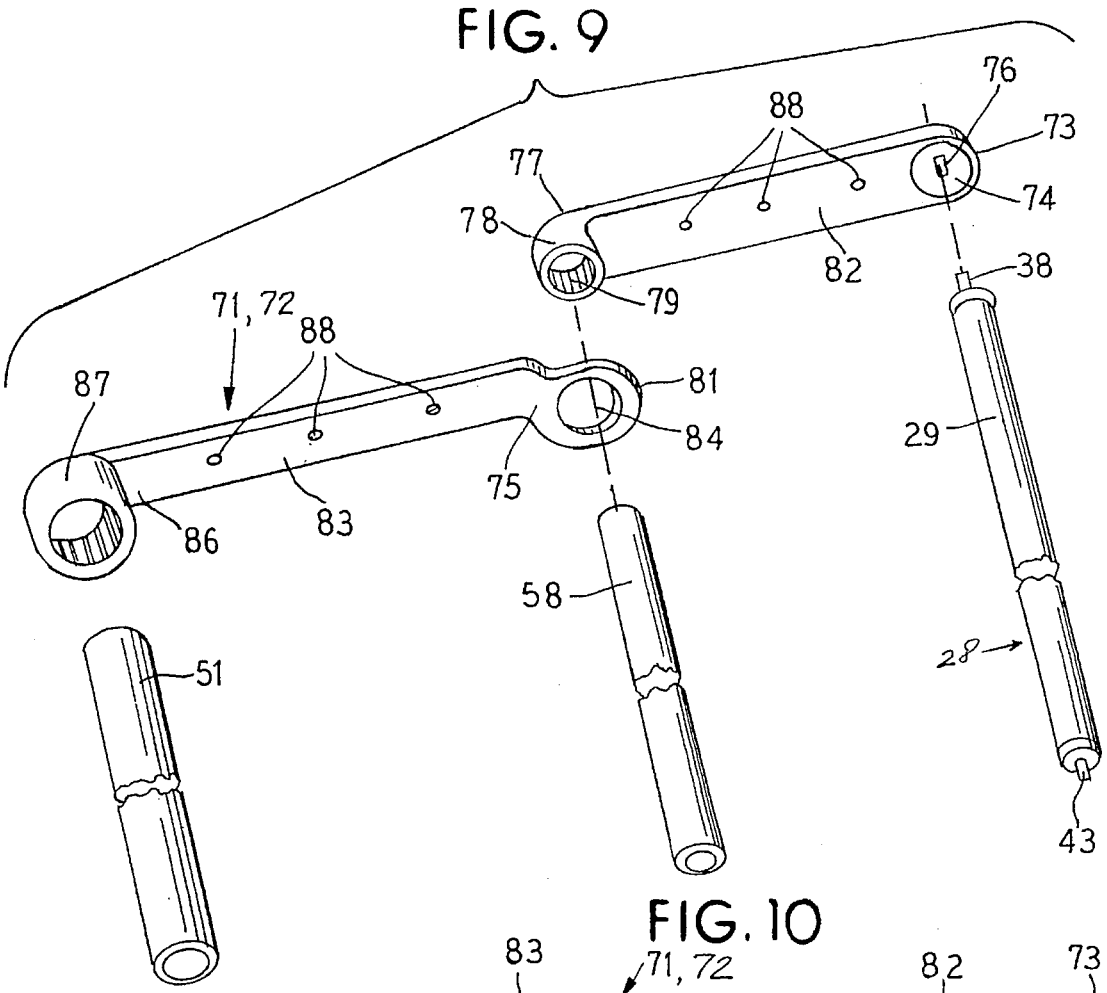
FIG. 9 is an exploded perspective view of another embodiment of a member of a pair of brackets that are adapted for use in the clothes protector apparatus of FIG. 1, this view showing as representative the left hand member of such bracket pair this bracket being shown in association with components of the clothes protector apparatus of FIGS. 1 and 2.
Figure 10:
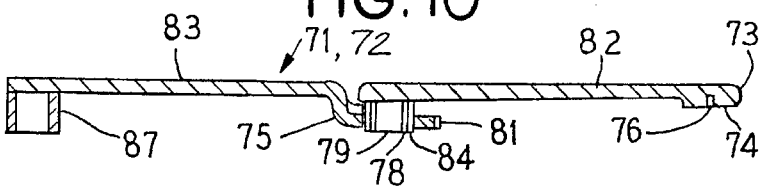
FIG. 10 is a fragmentary vertical sectional view through the central portion of the bracket shown in FIG. 9, this bracket being in an assembled configuration and adapted for use in association with components of the clothes protector apparatus of FIGS. 1 and 2.

To enhance the capability for simple and easy installation of apparatus 20 in a very wide variety of various closet installations, an alternative type of bracket structure can be employed for a pair of transversely extending, transversely elongated fastening bracket structures. Such an alternative structure can, for example medially hinged or pivotly associated, as illustrated by the embodiment of the left-hand bracket 71 shown in FIGS. 9–10 (the right-hand bracket 72, as before, being a mirror image of the left-hand bracket 71).

Bracket 71 is provided with a pair of elongated plates 82 and 83 which can each be formed of stamped, heavy gauge sheet metal or of unitarily molded plastic. Rearwardly located plate 82 has a rear end 73 that is provided with a projecting or raised "blister" 74 whose configuration is chosen to resemble that of a bracket 39 for purposes of supporting the axially projecting shaft 38 of a conventional shade motor 36 (as above described) in a roller assembly 28. Thus, blister 74 is provided with a receiving slot 76 at the blister 74 apex. Alternatively, if desired, the end 73 can be provided with a square configured support collar (not shown) for receiving one end of alternative roller assembly 101. Plate 82 has a forward end 77 that is provided with a projecting or raised circular collar 78 that is defined about an enclosed, rounded aperture 79. The aperture 79 is sized so that one end of rod-like structure 58 is receivable therein.

Forwardly located plate 83 has a rear end region 81 that is longitudinally (relative to closet 21) offset from the remainder of plate 83 in a bent region 75. End region 81 is provided with an aperture 84 that is sized to be receivable over and around the circular collar 78 of plate 82, and, when so received, plate 83 is pivotably movable about collar 78. Plate 83 has a forward end 86 that is provided with a projecting or raised circular collar 87 that is sized so that one end of rod-like structure 51 is receivable therein.

Each of the plates 82 and 83 is provided with a plurality of holes 88 through which conventional fasteners, such nails, screws or the like, can be extended for purposes of mounting to an end wall 23. In use, the plate 82 is first conveniently positioned on (flat against) a closet end wall 23 or the like at an orientation angle (which can be horizontal) where the collar 78 is at a chosen location over hanger bar 22 and where the blister 74 lies along an interference-free pathway to the collar 78. Then, plate 82 is mounted in this position to end wall 23. Next, the plate 83 is positioned on the end wall 23 with the aperture 84 engaged about the collar 78, and the plate 83 is positioned at an inclination angle (which may be horizontal) such that collar 87 is above the shoulders of clothes 26 and without interference with clothes 26 on a vertical pathway therebeneath. Then, plate 83 is mounted in this position to end wall 23. Pivotal movements of plate 83 relative to plate 82 are achievable while maintaining each of the brackets 71 and 72 in a generally coplanar relationship, thereby to adapt bracket 71 to various closet configurations.

Thus, the centrally pivotable or hinged bracket 71 is well adapted for installation of apparatus 20 in closets where the roller assembly 28, the rod-like structure 51 and the rod-like structure 58 are not in coplanar, spaced, parallel alignment as needed when using bracket structures 59 and 60.

Figure 11:
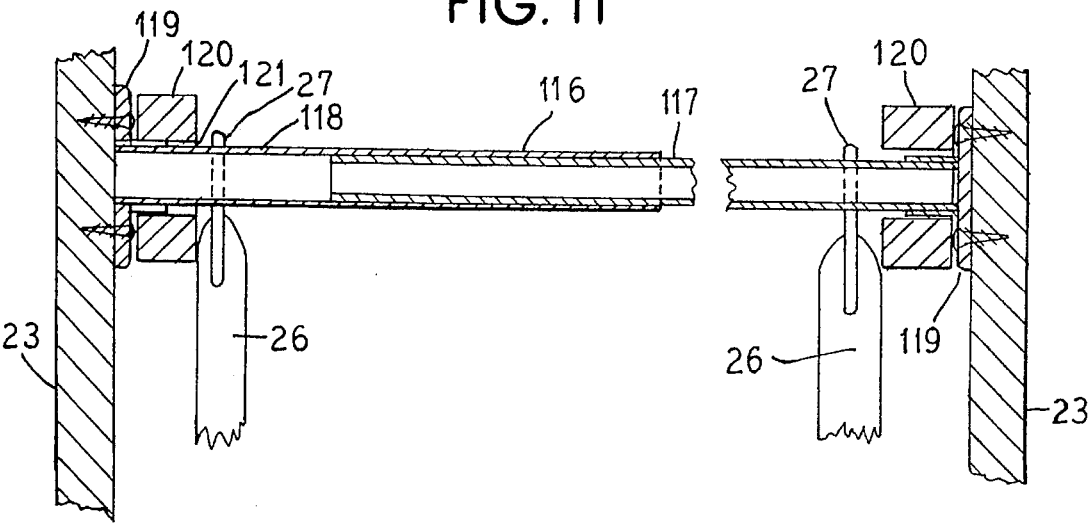
FIG. 11 is a fragmentary vertical longitudinally taken view through one embodiment of a hanger bar that is equipped with optional spacer pads adapted for use with the clothes protector apparatus of this invention.

Referring to FIG. 11, there is seen one embodiment of a hanger bar 116 that is here comprised of a pair of telescopically engaged sections 117 and 118, and that is here supported at its respective opposite ends by conventional brackets 119 relative to the end walls 23. The bar 116 supports items of clothing 26 on hangers 27 that are hung from the bar 116. Because the sheet 33 may have, when extended so as to be in a dust protective configuration such as shown in FIG. 1, opposite edge portions that are in spaced relationship to the opposite end walls 23 (owing to the configuration of a given closet), clothes 26 that are hung at opposite ends of the bar 116 can be adjacent to the end walls 23. When so adjacent to the end walls 23, the clothes so hung are possibly exposed to vertical dust settling.

To avoid such exposure, a pair of resilient spaced pads 120 (which can be comprised of resilient foamed polyurethane or the like, if desired) are provided for hanger bar 116. The pads 120 are each provided with a central passageway 121 whose diameter permits each pad to be extended over a different opposite end portion of bar 116. Each pad 120 is thus positionable along a different opposite end region of bar 116 so that the clothes 26 hung from the hangers 27 are all positionable in longitudinally spaced relationship to each one of the end walls 23 yet are maintained beneath and behind the extended sheet 33, thereby avoiding dust deposition.

Figure 12:
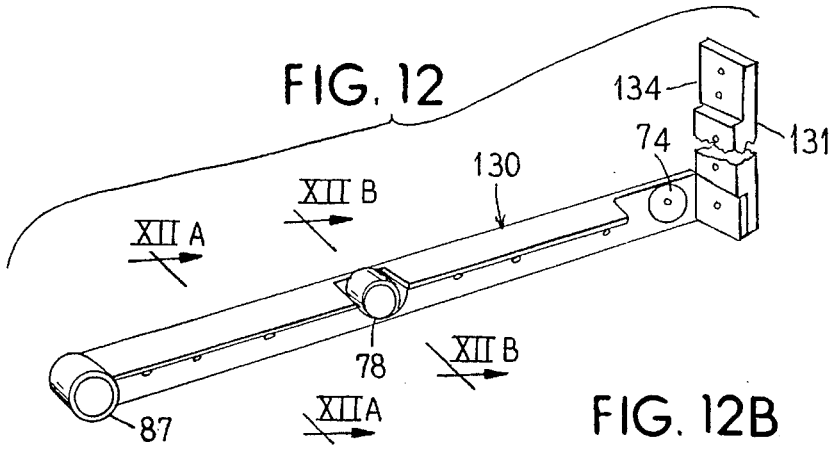
FIG. 12 is a perspective view of an alternative embodiment of a bracket assembly similar to that shown in FIGS. 9 and 10.
Figure 12B:
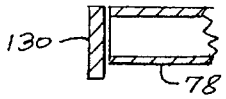
FIGS. 12A and 12B are transverse sectional views taken along the respective lines XIIA—XIIA and XIIB—XIIB of FIG. 12.
Figure 12A:
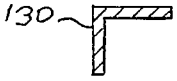

Referring to FIGS. 12, 12A and 12B, there is seen an alternative embodiment of a bracket 71 which is identified by the numeral 130. Corresponding parts are similarly numbered, but with the addition of prime marks for identification purposes. The bracket 130 uses arms formed of angle iron for structural integrity purposes. Also, the bracket 130 employs an integrally associated rear, perpendicular wall brace 131.

The clothes protector apparatus of this invention can be used in an application where multiple coaxial roller assemblies and associated rod-like members are employed, as when an elongated closet or other clothes storage area is to be dust protected. In such an application, a pair of brackets 130 are oriented in a back-to-back adjacent relationship. The adjoining braces 131 have a cavity 134 defined therebetween at their offset adjoining upper ends. A flat elongated supporting flat bar 132 is provided with a depending retaining plate 133 which is configured and oriented to be retained in the cavity 134 or in overlapping configuration with braces 131. The opposite end of the flat bar 132 is associated by welding or the like with a forwardly projecting flattened hook 136. The configuration of hook 136 is such that it extends about the forward edge portions of the pair of brackets 130. Thus, the braces 131 and the bar 132 coact to support the pair of brackets 130 when the braces are mounted to a back wall 25, upstanding post (not shown) or the like by conventional fastening means (screws, nails, etc.).

Figure 13A:
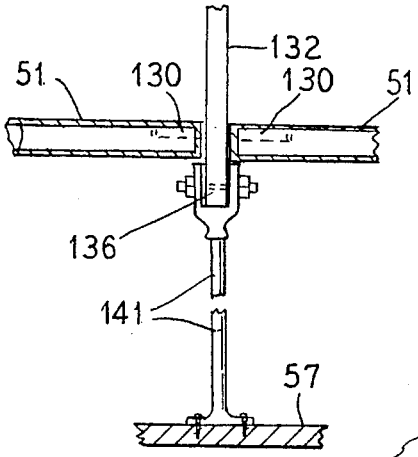
FIG. 13A is a fragmentary plan view of a portion of the assembly shown in FIG. 13, some parts thereof being broken away and some parts thereof being shown in section.
Figure 13:
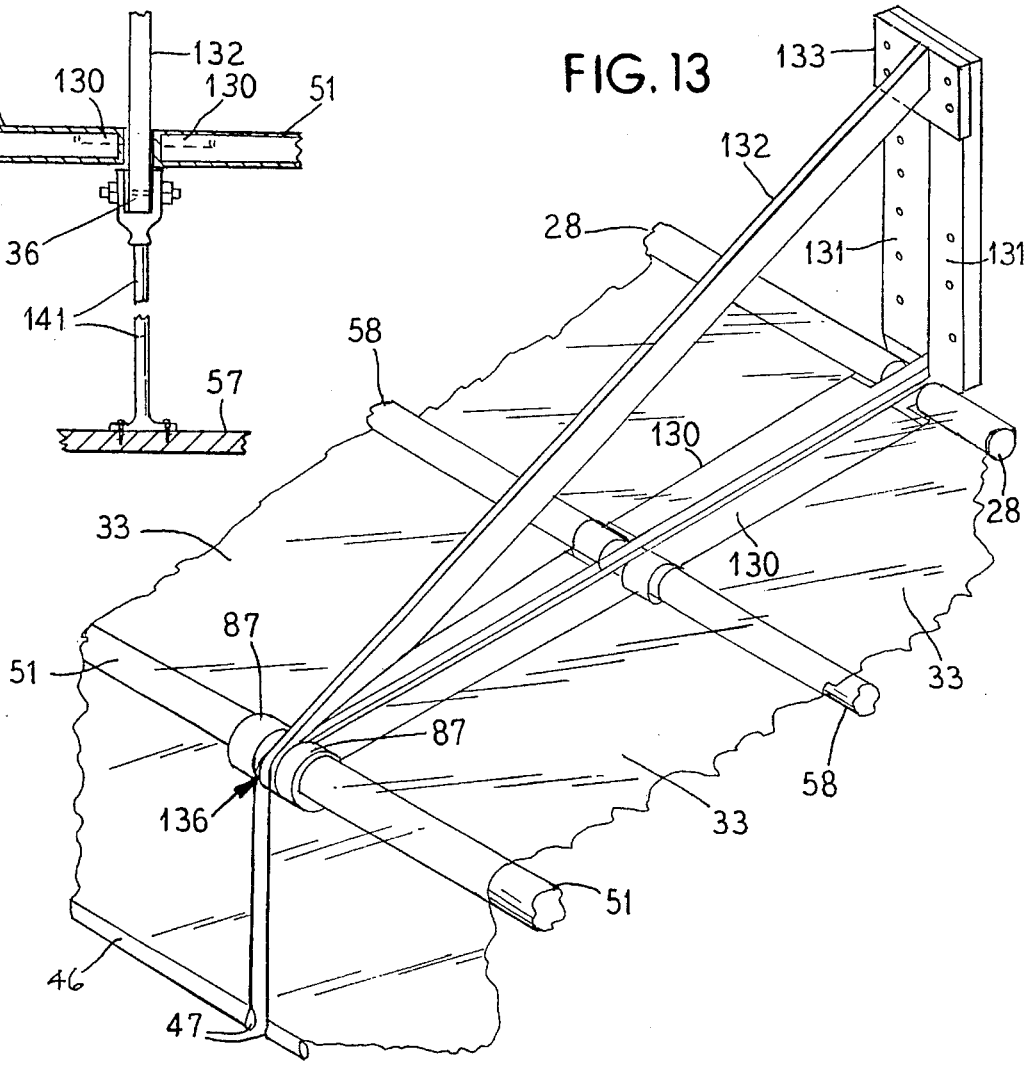
FIG. 13 is a fragmentary perspective view illustrating usage in apparatus of this invention of a bracket assembly such as shown in FIG. 12 to support a coaxial mounting of a pair of end-to-end associated roller assemblies and end-to-end associated rod-like members independently of any closet end wall or the like, some parts thereof being broken away.

Alternatively, a vertical bar member 141 can be provided which supports from the underlying floor the pair of brackets 130 at their front end, as shown for example in FIGS. 13A.

Although the present invention has been described and disclosed with reference to specific embodiments and theories, it is to be understood that these are by way of illustration only and that others may wish to utilize my invention in different designs or applications.

What is claimed is:

1. In a clothes closet of the type having clothes hanging perpendicularly downwardly from, and extending crosswise relative to, a generally horizontal hanger bar means that extends between, and is supported by, a pair of spaced parallel end walls, said closet further including a back wall extending between said end walls and adjacent to arm portions along one side of said clothes so that said clothes each have a respective shoulder portion located below and on a different opposed side of said hanger bar means, the improvement which comprises an associated clothes protector apparatus, said clothes protector apparatus comprising in combination:

(A) an elongated, roller apparatus including
  (1) roll means having outer circumferentially extending surface portions and opposite end portions;
  (2) a flexible, substantially dust impermeable, dimensionally stable sheet means that is secured to and initially spirally would about said circumferential surface portions;
  (3) means for selective extension, positioning and self powered retraction of said sheet means located substantially within said roll means but including generally coaxial shaft means outwardly extending at each of said opposite end portions; and
  (4) supporting means for said shaft means at each of said opposite end portions whereby said roller apparatus is adapted to be supportable between said end walls; and (B) at least one elongated guidance and support rod-like member, each said rod-like member having mounting means for mounting each said rod-like member between said end walls;

(C) said roller apparatus and said at least one rod-like members each being horizontally oriented and positioned in spaced, parallel relationship relative to one another and adapted to be supportable in spaced, parallel relationship relative to said hanger bar means with said roller apparatus being located over those said shoulder portions that are on one side of said hanger bar means adjacent to said back wall, and with at least one of said rod-like members being located over and to the outside of those said shoulder portions that are on said opposed side of said hanger bar means; whereby said sheet means is extendable from said roll means first generally transversely over said hanger bar means and then adapted to hang perpendicularly downwardly along the opposite side of said clothes without contact with said clothes.

2. The clothes closet of claim 1 wherein said clothes protector apparatus further includes a pair of transversely extending, transversely elongated fastening bracket means each said bracket means having a pair of opposite ends, each one of said bracket means having one said end thereof located at a different one of each of said opposite end portions of said roller apparatus, and having said opposed end thereof located at a different opposite end of one of said rod-like members, and said one bracket means end is associated with said supporting means while said opposed bracket means end is associated with said mounting means for said one rod-like member, and including means for fastening each said bracket means to one said end wall.

3. The clothes closet of claim 2 where, in said clothes protector apparatus, each of said bracket means is further associated in a mid-region thereof with said mounting means and a second said rod-like member is mountable thereby in spaced, parallel relationship to said roller apparatus and to said one rod-like member.

4. The clothes closet of claim 3 where, in said clothes protector apparatus, said mid-region of each said bracket means further incorporates pivot means whereby said one bracket means end is pivotable relative to said opposed bracket means end while maintaining said bracket means ends in a generally coplanar relationship.

5. The clothes closet of claim 1 where, in said clothes protector apparatus, said sheet means is transparent.

6. The clothes closet of claim 1 where, in said clothes protector apparatus, said sheet means is associated along its outer edge portion with an adjustable stiffener rod means.

7. The clothes closet of claim 1 where, in said clothes protector apparatus, said sheet means is associated along a mid-region of its outer edge portion with a handle means.

8. The clothes closet of claim 1 where, in said clothes protector apparatus, said roller apparatus further includes housing means that encloses said surface portions and said opposite end portions thereof and that has defined longitudinally therein slot means through which said sheet means is so extendable and retractable.

9. The clothes closet of claim 1 where, in said closet protector apparatus, further includes a pair of spacer means each one of which is positionable along a different opposite end region of said hanger bar means so that said clothes are positionable in longitudinally spaced relationship to each one of said end walls.

10. Clothes protector apparatus for installation in a closet type structure having clothes with paired opposed shoulder portions that hang perpendicularly downwardly from and extend generally normally relative to a supported horizontal hanger bar means, said hanger bar means extending generally parallel to a back wall associated with said closet-type structure, said back wall extending adjacent to said clothes so that said clothes each have one respective shoulder portion of the pair thereof located on a different opposed side said hanger bar means, said apparatus comprising in combination:

(a) an elongated, roller assembly including (1) roll means having outer circumferentially extending side surface portions and opposite end portions;

(2) a flexible, substantially dust impermeable, dimensionally stable sheet means that has one end edge portion thereof secured to said circumferential side surface portions and that is initially spirally wound about said circumferential side surface portions;

(3) motor means for selective extension, positioning and self powered retraction of said sheet means, said motor means being located substantially within said roll means but including generally coaxial shaft means outwardly extending at each of said opposite end portions; and (4) supporting means for said shaft means at each of said opposite end portions whereby said roller assembly is adapted to be supportable in spaced, parallel relationship relative to said hanger bar means;

(b) at least one elongated guidance and support rod-like member located in spaced, parallel relationship to said roller assembly and having opposite end portions, each said rod-like member having mounting means for mounting each said opposite end portion of said rod-like member;

(c) said roller assembly and said rod-like member each being adjustable in length; and (d) bracket means for supporting the respective opposite ends of each of said roller assembly and said rod-like member, said bracket means including means for fastening said bracket means to wall portions of said closet-type structure; whereby said roller assembly and said at least one rod-like members are each horizontally orientable and positionable, supportable in spaced, parallel relationship relative to one another and adapted to be supportable in spaced, parallel relationship relative to said hanger bar means with said roller assembly being located generally over those said shoulder portions that are on one side of said hanger bar means and with at least one of said rod-like members being located generally over and to the outside of those said shoulder portions that are on said opposed side of said hanger bar means, and whereby said sheet means is extendable from said roll means first generally transversely so as to pass over and against said at least one rod-like member and then adapted to hang perpendicularly downwardly adjacent to said shoulder portions on that said side of said hanger bar means which is remote from said back wall.

11. The clothes protector apparatus of claim 10 wherein said supporting means and said mounting means are each associated with a different one of a pair of spaced parallel end walls located adjacent to said opposite end portions of said roller assembly and said rod-like member.

12. The clothes protector apparatus of claim 10 wherein a second rod-like member is mounted in spaced, parallel relationship to and between said roller assembly and said one rod-like member so that said sheet means, when so extended, also passes over and against said second rod-like member.

13. The clothes protector apparatus of claim 10 which further includes a pair of transversely extending, transversely elongated fastening bracket means, each said bracket means having a pair of opposite bracket ends, each one of said bracket means having one said bracket end thereof located at a different one of each of said opposite end portions of said roller assembly, and having said opposed bracket end thereof located at a different opposite end portion of said at least one rod-like member, and including fastening means for each said bracket means, said one bracket end of each said bracket means being associated with said supporting means while said opposed bracket end of each said bracket means being associated with said mounting means.

14. The clothes protector apparatus of claim 13 wherein each of said elongated fastening bracket means is further associated in a mid-region thereof with further said mounting means wherein a second said rod-like member is mountable thereby in spaced, parallel relationship to and between said roller assembly and said one rod-like member.

15. The clothes protector apparatus of claim 13 wherein each of said elongated fastening bracket means is further associated in a mid-region thereof with pivot means whereby said one bracket end is pivotable relative to said opposed bracket end while said opposite bracket ends are maintainable in a generally coplanar relationship relative to each other.

16. The clothes protector apparatus of claim 10 wherein said sheet means is transparent.

17. The clothes protector apparatus of claim 10 wherein said roll means includes a first generally cylindrical section and a second generally cylindrical section, said first section being telescopically and adjustably receivable within at least a portion of said second section whereby the length of said roll means is adjustable.

18. The clothes protector apparatus of claim 10 wherein said sheet means includes a plurality of spaced, parallel tear lines that extend parallel to one edge thereof for the full length thereof whereby the width of said sheet means is adjustable.

19. The clothes protector apparatus claim 10 wherein each one of said rod-like members includes a first generally cylindrical section and a second generally cylindrical section, said first section being telescopically and adjustably receivable within at least a portion of said second section, whereby the length of each said rod-like member is adjustable.

20. The clothes protector apparatus of claim 10 wherein said sheet means is associated along its outer edge portion with a stiffener rod means whose length is adjustable.

21. The clothes protector apparatus of claim 10 wherein said sheet means is associated along a mid-region of its outer edge portion with a handle means.

22. The clothes protector apparatus of claim 10 wherein said roller assembly further includes longitudinally adjustable housing means that encloses said side surface and said opposite end portions thereof and that has defined longitudinally therein slot means through which said sheet means is so extendable and retractable.

23. The clothes protector apparatus of claim 10 which further includes a pair of spacer means each one of which is positionable along a different opposite end region of said hanger bar means so that said clothes are positionable in longitudinally spaced relationship to the respective opposite ends of said hanger bar means and are located beneath and behind said sheet means when said sheet means is extended.

24. The clothes protector apparatus of claim 10 which is cooperatively associated with said closet-type structure.

25. A clothes protector apparatus for clothes with paired opposed shoulder portions that are hanging perpendicularly downwardly from, and extend generally crosswise relative to, a generally horizontally oriented hanger bar means that extends generally between a pair of opposed spaced parallel end walls in a closet-type structure that also has a back wall that extends both between said pair of opposite end walls and adjacent to said clothes so that said clothes each have one respective shoulder portion located below and on a different opposed side of said hanger bar mean's, said apparatus comprising in combination:

(a) an elongated, roller assembly including (1) roll means having outer circumferentially extending side surface portions and opposite end portions;

(2) a flexible, substantially dust impermeable, dimensionally stable sheet means that has one end edge portion thereof secured to said circumferential side surface portions and that is initially spirally wound about said circumferential side surface portions;

(3) motor means for selective extension, positioning and self powered retraction of said sheet means, said motor means being located substantially within said roll means but including generally coaxial shaft means outwardly extending at each of said opposite end portions; and (4) supporting means for said shaft means at each of said opposite end portions whereby said roller assembly is adapted to be supportable in spaced, parallel relationship relative to said hanger bar means; the length of said roll means and the width of said sheet means each being shortenable without interference with the operatibility of said motor means;

(b) at least one elongated guidance and support rod-like member located in spaced, parallel relationship to said roller assembly and having opposite end portions, each said rod-like member having mounting means for mounting each said opposite end portion of said rod-like member, and each said rod-like member including means for adjusting the longitudinal length thereof; and (c) a pair of transversely extending, transversely elongated fastening bracket means, each said bracket means having a pair of opposite bracket ends, each one of said bracket means having one said bracket end thereof located at a different one of each of said opposite end portions of said roller assembly, and having said opposed bracket end thereof located at a different opposite end of one of said rod-like members, and said one bracket end of each said bracket means is associated with said supporting means while said opposed bracket means end of each said bracket means is associated with said mounting means, and including means for fastening and holding each said bracket means;

whereby said roller assembly and said at least one rod-like members are each horizontally orientable and positionable in spaced, parallel relationship relative to one another and adapted to be supportable in spaced, parallel relationship relative to said hanger bar means with said roller assembly being located generally over those said shoulder portions that are on one side of said hanger bar means and with said one rod-like members being located over and to the outside of those said shoulder portions that are on said opposed side of said hanger bar means, and whereby said sheet means is extendable from said roll means first generally transversely so as to pass over and against said one rod-like member and then hang perpendicularly downwardly.

26. The clothes protector apparatus of claim 25 wherein each of said bracket means is further associated in a mid-region thereof with said mounting means, and a second said rod-like member is mountable thereby in spaced, parallel relationship to and between said roller apparatus and said one rod-like member.

27. The clothes protector apparatus of claim 26 wherein said mid-region of each said bracket means further incorporates pivot means whereby said one bracket means end is pivotable relative to said opposed bracket means end while maintaining said opposite bracket means ends in a generally coplanar relationship.

28. The clothes protector apparatus of claim 25 wherein said sheet means is transparent.

29. The clothes protector apparatus of claim 25 wherein said sheet means is associated along its outer horizontal edge portion with an adaptable stiffener rod means.

30. The clothes protector apparatus of claim 26 wherein said sheet means is associated along an outer middle portion of a horizontal edge portion thereof with a handle means.

31. The clothes protector apparatus of claim 25 wherein said roller assembly further includes housing means that encloses said side surface and said opposite end portions thereof and that has defined longitudinally therein slot means through which said sheet means is so extendable and retractable.

32. The clothes protector apparatus of claim 25 which further includes a pair of spacer means each one of which is positionable along a different opposite end region of said hanger bar means so that said clothes are positionable in longitudinally spaced relationship to each one of said end walls and beneath.

33. The clothes protector apparatus of claim 25 which is cooperatively and functionally associated with said closet-type structure.

* * * * *

UNITED STATES PATENT AND TRADEMARK OFFICE

CERTIFICATE OF CORRECTION

PATENT NO. : 5,564,577

DATED : October 15, 1996

INVENTOR(S) : Pearl M. Knaggs

It is certified that error appears in the above-indentified patent and that said Letters Patent is hereby corrected as shown below:

Column 9, line 53, after "example" insert —,—.

Column 16, Claim 29, line 31, change "adaptable" to —adjustable—.

Signed and Sealed this

First Day of April, 1997

Bruce Lehman

BRUCE LEHMAN

*Commissioner of Patents and Trademarks*

*Attest:*

*Attesting Officer*